US005616425A

United States Patent [19]

Wilde

[11] Patent Number: 5,616,425

[45] Date of Patent: Apr. 1, 1997

[54] BEAM BLANKS FOR DIRECT ROLLING AS-CAST INTO FINISHED PRODUCTS

[75] Inventor: William J. Wilde, Bath, Pa.

[73] Assignee: Bethlehem Steel Corporation

[21] Appl. No.: 315,159

[22] Filed: Sep. 29, 1994

Related U.S. Application Data

[62] Division of Ser. No. 86,074, Jul. 1, 1993, Pat. No. 5,386,869.

[51] Int. Cl.[6] ..... E04C 3/06

[52] U.S. Cl. ..... 428/682; 428/587; 428/595; 428/598

[58] Field of Search ..... 428/577, 582, 428/587, 595, 598, 603

[56] References Cited

U.S. PATENT DOCUMENTS

| | | | |
|---|---|---|---|
| 4,106,551 | 8/1978 | Inoue | 164/448 |
| 4,565,336 | 1/1986 | Masui | 164/418 |
| 4,774,995 | 10/1988 | Fastert | 164/418 |
| 4,805,685 | 2/1989 | Lorento | 164/459 |
| 5,036,902 | 8/1991 | Streubel et al. | 164/436 |
| 5,082,746 | 1/1992 | Forward et al. | 428/598 |

*Primary Examiner*—John Zimmerman
*Attorney, Agent, or Firm*—Harold I. Masteller

[57] ABSTRACT

Continuously cast beam blanks having an adjusted flange shaped to provide an (Aw/Af) ratio for direct rolling as-cast into an entire range of finish products in a family of structural shapes.

18 Claims, 1 Drawing Sheet

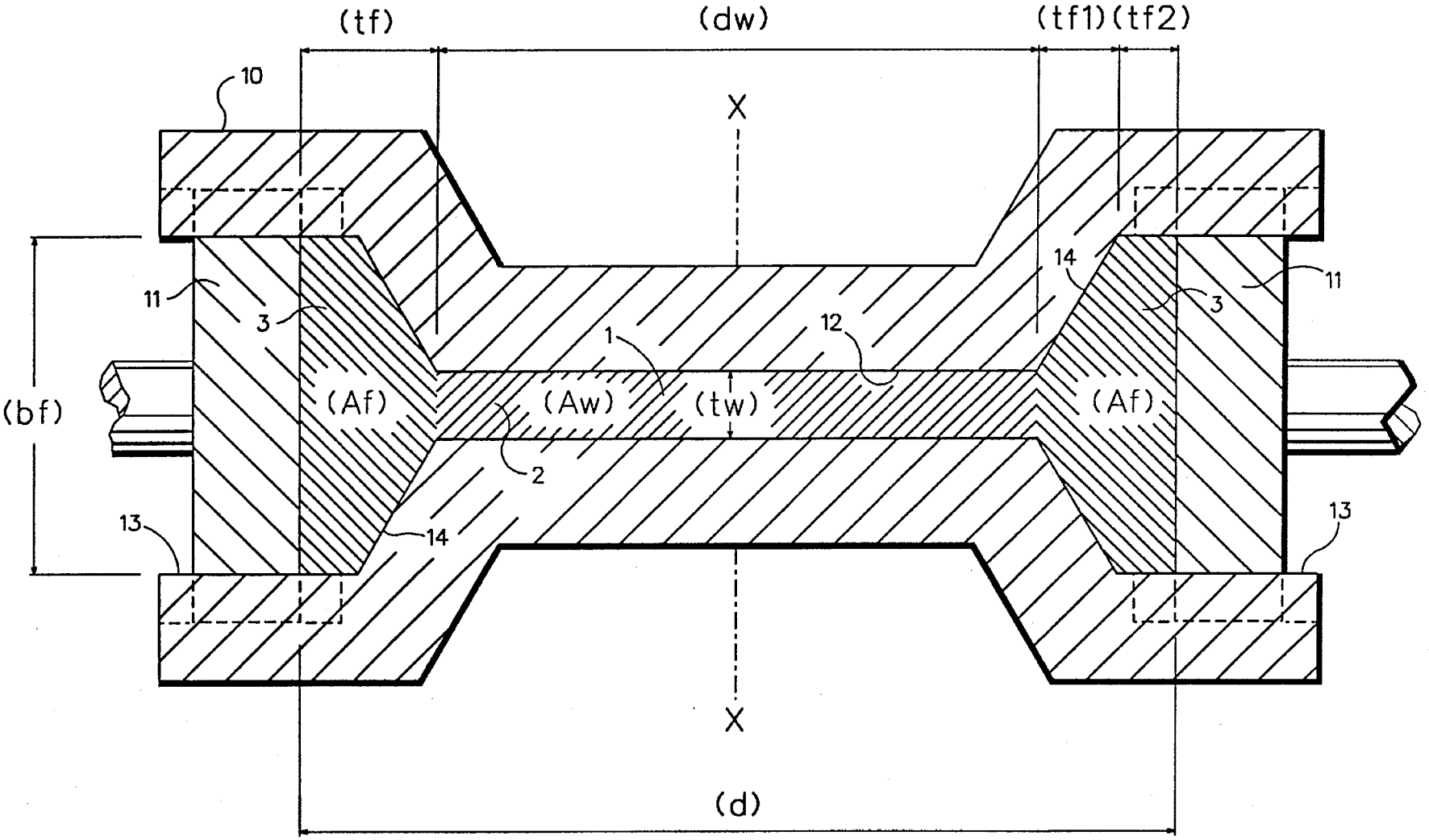
(tf1)(tf2)
(dw)
(tf)
(bf)
(d)
(tw)
(Af)
(Aw)
X
X
1
2
3
10
11
12
13
14

BEAM BLANKS FOR DIRECT ROLLING AS-CAST INTO FINISHED PRODUCTS

This is a division of application Ser. No. 08/086,074 filed on Jul. 1, 1993, now U.S. Pat. No. 5,386,869 granted Feb. 7, 1995.

BACKGROUND OF THE INVENTION

This invention relates to continuous cast beam blanks from which structural beam products are rolled, and in particular, it relates to a method of continuously casting variable flange beam blanks suited for rolling into an entire range of finished beam shapes within a family of structural beam products by only finish rolling, i.e., without the need for altering the as-cast geometry in a breakdown stand, or roughing stands, or the like, prior to finish rolling.

Kawasaki Steel Technical Report No. 3, dated September 1981, discloses that state of the art beam blanks are continuously cast to shapes which conform as close as possible to their final rolled beam size. This casting practice was established because it improves both the quality and yield of the finished beam products. This improvement is realized because the small dimensional changes required to roll the finished beam product reduces many rolling mill problems such as tongue elongation, end cropping loss, and irregular flange thickness. These rolling problems are normally encountered because of an improper understanding of the volumetric relationship between the various components of the cast beam blank and the finished beam product. Because the state of the art continuous cast beam blank is sized as close as possible to its finished beam size, it can only be universally rolled, as-cast, into a limited number of selected finished beam products within a beam family, not the entire range of beam products.

To further emphasize this point, we refer to a paper entitled "The Continuous Casting of Beam Blanks at the Algoma Steel Corp., Ltd." given at the 77th General Meeting of the American Iron and Steel Institute, (AISI). The AISI publication teaches that Algoma has continuously cast and used the beam blanks A through C shown in FIG. 1. Algoma discloses that its beam blank A is suited for rolling into 14 finished beam product sizes, beam blank B yields 12 finished beam products, and beam blank C can be rolled into 7 finished product sizes. In all cases, Algoma's as-cast beam blanks must first be rolled in a conventional Breakdown Mill to substantially alter the as-cast geometry prior to finish rolling in a Universal Mill.

As the state of the cast beam blank art advanced, the industry began to recognize the need to consider the relationship between cast beam blanks and their corresponding finished beam products. It also recognized a need to provide adjustable casting molds to increase production and yield.

U.S. Pat. No. 5,082,746 granted to Forward, et at. addresses the relational need by disclosing an as-continuously cast beam blank that, 1) approximates the finished shape and configuration of the beam or other structural shape desired, 2) minimizes the number of rolling passes or that must be undergone to reach the desired final size, and 3) controls the relationship between web thickness and flange thickness to effect control over both required working and minimize tearing of flanges and undesired elongation and/or buckling of web portions of the beam blank. Forward further discloses providing a continuously cast beam blank wherein the web of the blank has an average thickness of no greater than 3 inches, and the ratio of the average thickness of the flange precursor portions to the average thickness of the web portion is between 0.5:1 to about 2:1.

Although Forward teaches a need to balance the thickness ratio between the web and flange portions of his cast beam blank, he fails to recognize the need to balance the web/flange cross-sectional area ratio. He has also failed to recognize the need to correlate such web/flange ratios with their corresponding ratios in the desired finished product.

Struebel, et al. addresses the need for an adjustable continuous casting mold in his U.S. Pat. No. 5,036,902. He teaches adjusting the end walls of a continuous casting mold to vary the flange thickness of a beam blank. However, Struebel fails to either teach or even suggest varying his cast beam blank flange thickness to effect a desired web/flange area ratio which substantially equals a corresponding ratio in a desired finished product. In most instances, in the absence of such teaching, Struebel's cast beam blanks will realize poor product yield and incur considerable rolling problems as described above.

Because of the current state of the cast beam blank art, manufactures are unable to cast beam blanks which are suited for rolling into an entire family of structural beam products without first making significant modifications to the as-cast beam blank in a Breakdown Mill. A family of structural beam products is the entire range of beam sizes having a like beam depth (d). For example, all the finished beam products falling within the W36×393 through W36×135 range of wide flange beam sizes as listed in, "Bethlehem Structural Shapes", Catalog 3277 and Catalog Insert 3277A, have a similar depth and are considered a family of structural beam products.

SUMMARY OF THE INVENTION

It is therefore an object of this invention to provide a single continuous cast variable flange beam blank suited for rolling any and all finished beam sizes within an entire family of finished beam products without making significant modifications to the as-cast beam blank in a breakdown stand, or roughing stand, or the like.

It is a further object of this invention to greatly reduce the amount of tongue elongation during the rolling of the finished beam product.

It is still a further object of this invention to minimize variations in either the flange thickness or web thickness during the rolling of the finished beam product.

And finally, it is a further object of this invention to provide a method for continuously casting a variable flange beam blank suited for rolling into any finished beam size within an entire family of finished beam products.

We have discovered that the foregoing objects can be attained with a method for continuously casting a beam blank having a flange width (bf) greater than the largest (bf) in a family of finished beam products, a web depth (dw) close to the roll width of a Universal Rolling Mill, and a web area to flange area ratio (Aw/Af) substantially equal to the (Aw/Af) of the desired finished beam size within a family of beam products.

BRIEF DESCRIPTION OF THE DRAWING

The drawing figure is a cross-sectional end view of an adjustable continuous caster mold and a continuously cast beam blank strand.

DETAILED DESCRIPTION OF THE INVENTION

Referring to the drawing figure, the cross-section of a continuously cast beam blank strand 1, shown within a continuous caster mold 10, comprises a web portion 2 identified by the cross-sectioned area Aw, and two flange portions 3 identified by the cross-sectioned areas Af. Various structural steel manufactures are currently rolling finished beam products from continuously cast beam blanks having the general configuration shown in the drawing. However, it has been discovered that these state of the an beam blanks can only be rolled, as cast, into a few, limited finished beam sizes. In most instances it is necessary to significantly modify such beam blanks in a Breakdown Mill prior to finish Universal Mill rolling. These limitations are primarily a result of an industry wide lack of understanding concerning the volumetric relationship between the various segments of the cast beam blank and their correlation with their corresponding segments in the finished beam product.

As shown in the above patents, and in particular as disclosed in U.S. Pat. No. 5,082,746, the current state of the cast beam blank art teaches a need to balance the thickness relationship between the web and flange portions of the beam blank to overcome the aforementioned problems experienced during rolling operations. To this end, Forward specifically teaches casting a beam blank having a 0.5:1 to about 2:1 flange to web thickness ratio. However, when cast beam blanks are based upon such thickness criteria, they must either be cast within tightly defined dimensional limits, or be significantly modified in a Breakdown Mill in order for them to be successfully rolled into a few desired finished beam sizes.

The present invention, which is directed to a beam blank cast to a shape having a web area to flange area ratio (Aw/Af) substantially equal to the web area to flange area ratio (Aw/Af) of a desired finished beam product, eliminates the need to cast a beam blank to tightly defined thickness dimensions. It has also been discovered that if the casting mold is adjusted to vary the flange area thereby maintaining a substantially equal (Aw/Af) ratio between the cast beam blank and desired finished product, such continuously cast beam blanks can be rolled into any finished beam size within an entire family of beam products. Additionally, because the (Aw/Af) ratios are equal, the need for a Breakdown Mill is eliminated and rolling elongation between the flange and web portions is equalized. As a result, tongue elongation and end cropping is greatly reduced, and both the product quality and yield are improved.

To better illustrate the inherent differences between a continuous cast beam blank having its dimensional properties based upon a web thickness to flange thickness ratio (tw/tf) and the same cast beam blank having its dimensions based upon an (Aw/Af) ratio, we refer to the entire family of finished 36 inch deep wide flange beam products produced by Bethlehem Steel Corporation. As shown in Table 1, a finished W36×393 beam, has an overall depth (d) of 37.38 inches and comprises a web depth (dw) of 33.400 inches, a web thickness (tw) of 1.220 inches, a flange width (bf) of 16.830 inches and a (tw/tf) ratio of 0.555. According to Forward's teaching, his continuous cast beam blank is based upon two criteria. The first criterion requires the beam blank to be cast into a shape which approximates the shape of the finished beam product, and the second criterion requires the (tw/tf) ratio of his beam blank to fall within a range of 0.5:1 to about 2:1.

Let us now consider what will occur if we continuously cast a family of beam blanks using Forward's teaching to adjust the casting mold to vary the flange thickness (tf) of the beam blanks. Because we want to cast a blank which will approximate the finished product, we will assume our mold will be sized to duplicate the geometry of the largest beam size in the W36 family. The adjustable end walls 11 of the caster mold 10 are set to cast a (tf) of 2.200 inches to match the finished product, and as shown in Table 1, the geometry of this cast beam blank closely matches the finished product. Therefore we should be able to cast and directly roll this beam blank in a Universal Mill with few or no problems.

Continuing with Forward's teaching, and remembering that we are unable to adjust either the web opening 12 or flange width 13 of the caster mold 10, we adjust the mold end walls 11 to increase or decrease of the (tf) of the beam blank flanges 3 as we move through the range of beam sizes listed in the W36 family of finished beam products. As further shown in Table 1, when the (tf) of a cast beam blank is varied to match the (tf) of a desired beam size, the cast beam blanks fall within the scope of Forward's teaching in that the beam blanks approximate the shape of the finished product, and the (tw/tf) ratios of the beam blanks fall within a 0.5:1 to 2:1 ratio range.

Even though the thickness ratios fall within Forward's range, Table 1 shows that problems will occur when the beam blanks are rolled into the finished beam size. For example, if we compare the web and flange cross-sectional areas of the W36×393 beam, we find that both the web and flange portions elongate equally during the rolling of the as-cast beam blank into its finished product, i.e., (web 40.748/40.748=1, flange 37.026/37.026=1). This is verified by the equal (Aw/Af) ratio of 1.101 shown in the table. However, if we continue to apply Forward's teaching to both the as-cast beam blank and its finished product for the other beam sizes within the W36 family we find that the as-cast (Aw/Af) ratio is no longer equal to the (Aw/Af) ratio of the finished product. For example, in the case of the W36×256 beam size, we find that the web portion and the flange portion elongate unequally during the rolling of the as-cast W36×256 beam blank into its finished product, i.e., (web 40.748/32.611=1.250, flange 37.009/21.132=1.751). This is because in the absence of metal cross flow during finish rolling, the web portion of the W36×256 as-cast beam blank will attempt to finish 1.402 times longer than its flange portion, i.e., (1.751/1.250=1.402). This unequal elongation between the web and flange portions increases the tendency for web buckling and/or flange thinning during the finish rolling of the product, and such rolling problems are difficult, if not impossible to control. It is very difficult to effect a high degree of metal cross flow in a Universal Mill. In order to achieve a high volume metal cross flow, the as-cast beam blank must first be reshaped in a Breakdown Mill before being sent to the finish rolling operations of the Universal Mill. Even then, much of the excess material will form into elongated tongues and will be lost during end cropping of the Breakdown Mill product. Therefore, Forward's as-cast beam blank cannot be sent directly to a Universal Mill, and the process of reshaping his as-cast beam blank in a Breakdown Mill will result in substantial product loss due to uneven elongation and cropping.

As clearly shown in Table 1, if the (tf) of a beam blank is systematically varied to match the (tf) of a desired finished beam product, and even though the beam blank geometry falls within the taught (tw/tf) ratio range, unequal distribution of metal between the flange and web portions of beam blank is a reoccurring problem throughout the entire beam family.

The present invention is directed to a heretofore unknown method of continuously casting an improved variable flange beam blank for direct rolling into any and all finished beam sizes within a given beam family. The finished beam can be directly finish rolled without any flange unevenness, tongue elongation, or cropping loss.

To continuously cast an improved beam blank, three criteria must be met. The first criterion requires that the flange width opening 13 of the continuous caster mold 10 must be larger than the flange width (bf) of the largest beam size in the family of beam products. Second, the web opening 12 of the caster mold must be sized to cast a beam blank having a web depth (dw) close to the Universal Mill roll width. And third, the end walls 11 of the caster mold must be adjusted to cast a beam blank having an (Aw/Af) ratio substantially equal to the (Aw/Af) ratio of the desired finished beam size.

TABLE 1

W36 WIDE FLANGE BEAM FAMILY
and
CAST BEAM BLANK BASED UPON FLANGE THICKNESS

| SECTION NUMBER | d inches | dw inches | bf inches | tf inches | tw inches | Af sq. in. | Aw sq. in. | tw/tf ratio | Aw/Af ratio |
|---|---|---|---|---|---|---|---|---|---|
| W36 × 393 Beam | 37.80 | 33.400 | 16.830 | 2.200 | 1.220 | 37.026 | 40.748 | 0.555 | 1.101 |
| Cast Beam Blank | | 33.400 | 16.830 | 2.200 | 1.220 | 37.026 | 40.748 | 0.555 | 1.101 |
| W36 × 359 Beam | 37.40 | 33.380 | 16.730 | 2.010 | 1.120 | 33.627 | 37.386 | 0.557 | 1.112 |
| Cast Beam Blank | | 33.400 | 16.830 | 2.189 | 1.220 | 36.841 | 40.748 | 0.557 | 1.205 |
| W36 × 328 Beam | 37.09 | 33.390 | 16.630 | 1.850 | 1.020 | 30.766 | 34.058 | 0.551 | 1.107 |
| Cast Beam Blank | | 33.400 | 16.830 | 2.213 | 1.220 | 37.245 | 40.748 | 0.551 | 1.309 |
| W36 × 300 Beam | 36.74 | 33.380 | 16.655 | 1.680 | 0.945 | 27.980 | 31.544 | 0.563 | 1.127 |
| Cast Beam Blank | | 33.400 | 16.830 | 2.169 | 1.220 | 36.504 | 40.748 | 0.563 | 1.441 |
| W36 × 280 Beam | 36.52 | 33.380 | 16.595 | 1.570 | 0.885 | 26.054 | 29.541 | 0.564 | 1.134 |
| Cast Beam Blank | | 33.400 | 16.830 | 2.164 | 1.220 | 36.420 | 40.748 | 0.564 | 1.542 |
| W36 × 260 Beam | 36.26 | 33.380 | 16.550 | 1.440 | 0.840 | 23.832 | 28.039 | 0.583 | 1.177 |
| Cast Beam Blank | | 33.400 | 16.830 | 2.091 | 1.220 | 35.192 | 40.748 | 0.583 | 1.681 |
| W36 × 256 Beam | 37.43 | 33.970 | 12.215 | 1.730 | 0.960 | 21.132 | 32.611 | 0.555 | 1.543 |
| Cast Beam Blank | | 33.400 | 16.830 | 2.199 | 1.220 | 37.009 | 40.748 | 0.555 | 1.400 |
| W36 × 245 Beam | 36.08 | 33.380 | 16.510 | 1.350 | 0.800 | 22.289 | 26.704 | 0.593 | 1.198 |
| Cast Beam Blank | | 33.400 | 16.830 | 2.059 | 1.220 | 34.653 | 40.748 | 0.593 | 1.793 |
| W36 × 232 Beam | 37.12 | 33.980 | 12.120 | 1.570 | 0.870 | 19.028 | 29.563 | 0.554 | 1.554 |
| Cast Beam Blank | | 33.400 | 16.830 | 2.202 | 1.220 | 37.060 | 40.748 | 0.554 | 1.542 |
| W36 × 230 Beam | 35.90 | 33.380 | 16.470 | 1.260 | 0.760 | 20.752 | 25.369 | 0.603 | 1.222 |
| Cast Beam Blank | | 33.400 | 16.830 | 2.023 | 1.220 | 37.076 | 40.748 | 0.603 | 1.922 |
| W36 × 210 Beam | 36.69 | 33.970 | 12.180 | 1.360 | 0.830 | 16.565 | 28.195 | 0.610 | 1.702 |
| Cast Beam Blank | | 33.400 | 16.830 | 1.999 | 1.220 | 33.643 | 40.748 | 0.610 | 1.780 |
| W36 × 194 Beam | 36.49 | 33.970 | 12.115 | 1.260 | 0.765 | 15.265 | 25.987 | 0.607 | 1.702 |
| Cast Beam Blank | | 33.400 | 16.830 | 2.099 | 1.220 | 33.811 | 40.748 | 0.607 | 1.922 |
| W36 × 182 Beam | 36.33 | 33.970 | 12.075 | 1.180 | 0.725 | 14.249 | 24.628 | 0.614 | 1.728 |
| Cast Beam Blank | | 33.400 | 16.830 | 1.986 | 1.220 | 33.424 | 40.748 | 0.614 | 2.052 |
| W36 × 170 Blank | 36.17 | 33.970 | 12.030 | 1.100 | 0.680 | 13.233 | 23.100 | 0.618 | 1.746 |
| Cast Beam Blank | | 33.400 | 16.830 | 1.974 | 1.220 | 33.222 | 40.748 | 0.618 | 2.201 |
| W36 × 160 Beam | 36.01 | 33.970 | 12.000 | 1.020 | 0.650 | 12.240 | 22.080 | 0.637 | 1.804 |
| Cast Beam Blank | | 33.400 | 16.830 | 1.914 | 1.220 | 32.213 | 40.748 | 0.637 | 2.374 |
| W36 × 150 Beam | 35.85 | 33.970 | 11.975 | 0.940 | 0.625 | 11.257 | 21.231 | 0.655 | 1.886 |
| Cast Beam Blank | | 33.400 | 16.830 | 1.835 | 1.220 | 30.883 | 40.748 | 0.655 | 2.576 |
| W36 × 135 Beam | 35.55 | 33.970 | 11.950 | 0.790 | 0.600 | 9.4410 | 20.382 | 0.759 | 2.159 |
| Cast Beam Blank | | 33.400 | 16.830 | 1.606 | 1.220 | 27.029 | 40.748 | 0.759 | 3.065 |

Referring to Table 2 and the drawing figure, in order to meet the first criterion we observe that the largest finished beam size in the W36 family is the W36×393 beam. This beam has a (bf) of 16.830 inches and a web thickness (tw) of 1.220 inches. Knowing that the (bf) for the W36×393 is 16.830 inches, we can now furnish a properly sized flange width opening 13 in our caster mold 10 by providing a (bf) opening having a greater width than the largest (bf) in the W36 family of beams. For example, (16.830" largest W36 bf)+1.000"=(17.830" caster mold To meet the second criterion, and insure that the web depth (dw) of the improved beam blank is properly sized to fit the roll width of the Universal Mill, we simply set the (dw) of the web opening 12 to the common (dw) listed for the beam family. In this case the (dw) opening is 33.380 inches. In conjunction with the selection of the (dw), the web thickness of the mold opening 12 must also be considered. The (tw) of the as-cast beam blank must be greater than the (tw) of the finished beam product. However, the selection of the (tw) should also be based upon metallurgical properties desired in the finished product. Accordingly, the (tw) should be sized to permit a rolling reduction ran: which will impart a proper grain structure to the finished product. In this case, a (tw) of 5.000 inches has been selected to give a reduction rate of 4.1:1, a common reduction rate for most structural products. It should be remembered however, that depending upon the composition of rite material being rolled and the desired grain structure of the finished product, reduction rates can have a wide range of variations. Therefore, the important criterion is to provide an as-cast beam blank having a (tw) greater than the (tw) of its finished product.

Thus the first and second criteria have been met in that the improved cast beam blank will have a (bf) greater than the largest (bf) listed in the W36 beam family, and its (dw) will fit within the Universal Mill rolls. Both the caster mold web opening 12 and flange width opening 13 are fixed dimensions which cannot be adjusted to vary the geometry of the cast beam blank.

The third criterion, directed to the (Aw/Af) ratio, is adjustable to permit varying the improved beam blank (Aw/Af) ratio to equal the (Aw/Af) ratio of a finished beam product. As shown in the drawing, mold end walls 11 are capable of adjustment toward or away from the X—X axis of caster mold 10. Such end wall adjustment permits a wide variation of the cross-sectional flange area (Af) of the cast improved beam blank strand. Knowing that the cross-section of web opening 12 is 166.90 square inches, it is a simple matter to calculate that end walls 11 must be adjusted to cast an improved beam blank having an (Af) of 151.59 square inches to provide a matching 1.101 (Aw/Af) ratio.

To calculate the required end wall adjustment necessary for achieving a beam blank flange area of 151.59 square inches, we again refer to the drawing. Beam blank flanges 3 comprise a tapered portion (tf1) adjacent the beam blank web 2, and a rectangular portion (tf2) adjacent the caster mold adjustable end wall 11. The tapered portion (tf1) has a fixed cross-sectional area while the cross-sectional area portion (tf2) can be varied by adjusting the mold end walls 11.

Common Universal Mill practice has established that the inside flange angle 14 of the beam blank portion (tf1) should fall within an angle of between 10° to about 20°. However, it should be understood that almost any beam blank flange angle between 0 and 90 degrees can be used. A 15° angle has been selected for this example, and knowing this angle we can calculate that the flange portion area bound by (tf1) has a fixed cross-section of 19.630 square inches. From this we know that end wall 11 must be adjusted to create a rectangular flange opening of 131.96 square inches, i.e., (151.59 Af–19.630 tf1=131.96 square inches). Therefore, because we know that the (bf) opening is 17.830 inches, we must adjust the (tf2) to 7.40 inches in order to achieve the required 131.96 inch cross-sectional area.

As shown in Table 2, if end walls 11 are systematically adjusted to vary the (tf2) opening in accordance with the present invention, the (Aw/Af) ratios are matched throughout the entire beam family and the distribution of metal between the flange and web portions is equalized. The (Aw/Af) ratios for the W36 family fall within a ratio range from 1:1 to about 2:1. In considering a full line of I-beam or wide flange beam products starting with the W40 family through W4 family, it will be found that the finished product (Aw/Af) ratios fall within a ratio range from about 0.4:1 to about 2.6:1.

Such improved, continuously cast beam blanks facilitate rolling operations in that they can be sent directly to the Universal Mill and they experience no tongue elongation or yield loss due to rolling in a Breakdown Mill. Additionally, as illustrated in Table 2, a single caster mold can be used to cast an entire family of beam blanks, in this case 17 different beam sizes, and thereby increase the productivity of the industry.

While this invention has been illustrated and described in accordance with a preferred embodiment, it is recognized that variations and changes may be made therein without departing from the scope of the invention as set forth in the claims. For example, the continuous casting method invention based upon (Aw/Af) ratios can be adapted to use a single adjustable mold for casting improved beam blanks suited for rolling the entire range of finished beam sizes falling within two or more families of beam products. This new (Aw/Af)

TABLE 2

W36 WIDE FLANGE BEAM FAMILY
and
CAST BEAM BLANK BASED UPON AREA RATIOS

| SECTION NUMBER | d inches | dw in. | bf inches | tf inches | tw inches | Af sq. in. | Aw sq. in. | tw/tf ratio | Aw/Af ratio |
|---|---|---|---|---|---|---|---|---|---|
| W36 × 393 Beam | 37.80 | 33.400 | 16.830 | 2.200 | 1.220 | 37.026 | 40.748 | 0.555 | 1.101 |
| Improved Blank | | 33.380 | 17.830 | 8.502 | 5.000 | 151.59 | 166.90 | 0.548 | 1.101 |
| W36 × 359 Beam | 37.40 | 33.380 | 16.730 | 2.010 | 1.120 | 33.627 | 37.386 | 0.557 | 1.112 |
| Improved Blank | | 33.380 | 17.830 | 8.418 | 5.000 | 150.09 | 166.90 | 0.553 | 1.112 |
| W36 × 328 | 37.09 | 33.390 | 16.630 | 1.850 | 1.020 | 30.766 | 34.058 | 0.551 | 1.107 |
| Improved Blank | | 33.380 | 17.830 | 8.456 | 5.000 | 150.77 | 166.90 | 0.551 | 1.107 |
| W36 × 300 Blank | 36.74 | 33.380 | 16.655 | 1.680 | 0.945 | 27.980 | 31.544 | 0.563 | 1.127 |
| Improved Blank | | 33.380 | 17.830 | 8.306 | 5.000 | 148.09 | 166.90 | 0.560 | 1.127 |
| W36 × 280 Beam | 36.52 | 33.380 | 16.595 | 1.570 | 0.885 | 26.054 | 29.541 | 0.564 | 1.134 |
| Improved Blank | | 33.380 | 17.830 | 8.255 | 5.000 | 147.18 | 166.90 | 0.563 | 1.134 |
| W36 × 260 Beam | 36.26 | 33.380 | 16.550 | 1.440 | 0.840 | 23.832 | 28.039 | 0.583 | 1.177 |
| Improved Blank | | 33.380 | 17.830 | 7.953 | 5.000 | 141.80 | 166.90 | 0.583 | 1.177 |
| W36 × 256 Beam | 37.43 | 33.970 | 12.215 | 1.730 | 0.960 | 21.132 | 32.611 | 0.555 | 1.543 |
| Improved Blank | | 33.380 | 17.830 | 6.067 | 5.000 | 108.17 | 166.90 | 0.748 | 1.543 |
| W36 × 245 Beam | 36.08 | 33.380 | 16.510 | 1.350 | 0.800 | 22.289 | 26.704 | 0.593 | 1.198 |
| Improved Blank | | 33.380 | 17.830 | 7.814 | 5.000 | 139.32 | 166.90 | 0.593 | 1.198 |
| W36 × 232 Beam | 37.12 | 33.980 | 12.120 | 1.570 | 0.870 | 19.028 | 29.563 | 0.554 | 1.554 |
| Improved Blank | | 33.380 | 17.830 | 6.024 | 5.000 | 107.40 | 166.90 | 0.753 | 1.554 |
| W36 × 230 Beam | 35.90 | 33.380 | 16.470 | 1.260 | 0.760 | 20.752 | 25.369 | 0.603 | 1.222 |
| Improved Blank | | 33.380 | 17.830 | 7.660 | 5.000 | 136.58 | 166.90 | 0.604 | 1.222 |
| W36 × 210 Beam | 36.69 | 33.970 | 12.180 | 1.360 | 0.830 | 16.565 | 28.195 | 0.610 | 1.702 |
| Improved Blank | | 33.380 | 17.830 | 5.500 | 5.000 | 98.061 | 166.90 | 0.817 | 1.702 |
| W36 × 194 Beam | 36.49 | 33.970 | 12.115 | 1.260 | 0.765 | 15.265 | 25.987 | 0.607 | 1.702 |
| Improved Blank | | 33.380 | 17.830 | 5.500 | 5.000 | 98.061 | 166.90 | 0.817 | 1.702 |
| W36 × 182 Blank | 36.33 | 33.970 | 12.075 | 1.180 | 0.725 | 14.249 | 24.628 | 0.614 | 1.728 |
| Improved Blank | | 33.380 | 17.830 | 5.417 | 5.000 | 96.586 | 166.90 | 0.829 | 1.728 |
| W36 × 170 Blank | 36.17 | 33.970 | 12.030 | 1.100 | 0.680 | 13.233 | 23.100 | 0.618 | 1.746 |
| Improved Blank | | 33.380 | 17.830 | 5.361 | 5.000 | 95.590 | 166.90 | 0.836 | 1.746 |
| W36 × 160 Beam | 36.01 | 33.970 | 12.000 | 1.020 | 0.650 | 12.240 | 22.080 | 0.637 | 1.804 |
| Improved Blank | | 33.380 | 17.830 | 5.189 | 5.000 | 92.517 | 166.90 | 0.861 | 1.804 |
| W36 × 150 Beam | 35.85 | 33.970 | 11.975 | 0.940 | 0.625 | 11.257 | 21.231 | 0.655 | 1.886 |
| Improved Blank | | 33.380 | 17.830 | 4.963 | 5.000 | 88.494 | 166.90 | 0.896 | 1.886 |
| W36 × 135 Blank | 35.55 | 33.970 | 11.950 | 0.790 | 0.600 | 9.4410 | 20.382 | 0.759 | 2.159 |
| Improved Blank | | 33.380 | 17.830 | 4.336 | 5.000 | 77.304 | 166.90 | 1.009 | 2.159 |

ratio method of continuous casting beam blanks can also be adapted for casting and rolling asymmetrical flanges on beam products when each of the two flanges are considered individually, as well as other structural products such as structural tees or rails.

I claim:

1. An in-process structural shape being direct finished rolled from an as cast blank, comprising:

a) a structural shape member having a first finished section and a second blank section;

b) each of said sections has a flange portion with a cross sectional area Af;

c) each of said sections has a web portion with a cross-sectional area Aw; and d) the ratio Aw/Af resulting from the web portion cross sectional area Aw being divided by the flange portion cross-sectional area Af is equal for each of said sections.

2. The structural shape of claim 1, wherein:

a) said blank section flange portion has a surface extending angularly relative to said blank section web portion.

3. The structural shape of claim 2, wherein:

a) said surface extends at an angle within the range of 0° to 90°.

4. The structural shape of claim 1, wherein:

a) each of said sections has first and second flange portions between which the web portion extends; and b) the flange portion cross-sectional area Af of the first and second flange portions of each section are the same.

5. The structural shape of claim 4, wherein:

a) each flange portion of each section has a surface extending angularly relative to the associated web portion.

6. The structural shape of claim 4, wherein:

a) said first section forms an I-beam.

7. The structural shape of claim 1, wherein:

a) the ratio Aw/Af for each section is in excess of 1.0.

8. The structural shape of claim 7, wherein:

a) said web portion of each section is rectangular in cross-section.

9. The structural shape of claim 5, wherein:

a) said blank section surfaces extend at a common angle to the associated web portion.

10. An in-process structural shape being direct finished rolled from an as cast blank, comprising:

a) a finished section having at least one flange portion cross-sectional area (Af), a web cross-sectional arm (Aw) and a finished section ratio (Aw/Af) resulting from the web portion cross-sectional area (Aw) being divided by the flange portion cross-sectional area (Af); and b) a blank section having at least one flange portion cross-sectional area (Af), a web cross-sectional area (Aw) and a blank section ratio (Aw/Af) resulting from the web portion cross-sectional area (Aw) being divided by the flange portion cross-sectional area (Af), said blank section ratio (Aw/Af) being equal to said finished section ration (Aw/Af).

11. The structural shape of claim 10, wherein:

a) said blank section flange portion has a surface extending angularly relative to said blank section web portion.

12. The structural shape of claim 11, wherein:

a) said surface extends at an angle within the range of 0° to 90°.

13. The structural shape of claim 10, wherein:

a) each of said sections has first and second flange portions between which the web portion extends; and b) the flange portion cross-sectional area Af of the first and second flange portions of each section are the same.

14. The structural shape of claim 13, wherein:

a) each flange portion of each section has a surface extending angularly relative to the associated web portion.

15. The structural shape of claim 13, wherein:

a) said finished section forms an I-beam.

16. The structural shape of claim 10, wherein:

a) the ratio Aw/Af for each section is in excess of 1.0.

17. The structural shape of claim 16, wherein:

a) said web portion of each section is rectangular in cross-section.

18. The structural shape of claim 14, wherein:

a) said blank section surfaces extend at a common angle to the associated web portion.

* * * * *